United States Patent [19]

Barker et al.

[11] 3,978,702

[45] Sept. 7, 1976

[54] METAL COLD FORMING PROCESS AND LUBRICANT COMPOSITION THEREFOR

[75] Inventors: George E. Barker, Evanston; Stephen C. Cohen, Highland Park, both of Ill.; John L. O'Brien, Winchester; Jack Milgrom, Concord, both of Mass.

[73] Assignee: Van Straaten Chemical Company, Chicago, Ill.

[22] Filed: Nov. 12, 1975

[21] Appl. No.: 631,242

Related U.S. Application Data

[60] Division of Ser. No. 466,643, May 3, 1974, which is a continuation-in-part of Ser. No. 372,125, June 21, 1973, abandoned.

[52] U.S. Cl. ..... 72/42

[51] Int. Cl.[2] ..... B21C 23/32

[58] Field of Search ..... 72/42, 46; 252/37, 49.5, 252/49.7, 58

[56] References Cited

UNITED STATES PATENTS

| | | | |
|---|---|---|---|
| 3,250,013 | 5/1966 | Beaubien et al. | 72/42 |
| 3,258,319 | 6/1966 | Cox | 72/42 X |
| 3,433,038 | 3/1969 | Stump | 72/42 |
| 3,568,486 | 3/1971 | Rosenberg et al. | 72/42 |
| 3,776,848 | 12/1973 | Hall et al. | 252/49.5 |

*Primary Examiner*—C.W. Lanham
*Assistant Examiner*—E. M. Combs
*Attorney, Agent, or Firm*—Neuman, Williams, Anderson & Olson

[57] ABSTRACT

A method of cold forming ferrous metals is disclosed employing as a cold-forming lubricant a dry solid coating comprising a film of a chlorine-containing, film-forming polymer and a destabilizing agent applied to the surface of a ferrous metal workpiece, which surface is free from other coatings or surface treatment, said coating being applied as a liquid composition and to particular coating compositions.

7 Claims, No Drawings

METAL COLD FORMING PROCESS AND LUBRICANT COMPOSITION THEREFOR

This is a division of application Ser. No. 466,643 filed May 3, 1974, which, in turn, is a continuation-in-part of Ser. No. 372,125, filed June 21, 1973, now abandoned.

BACKGROUND OF THE INVENTION

1. Field of the Invention

This invention relates to methods of cold forming, more particularly, backward and forward extrusion of ferrous metal workpieces using as a lubricant a coating composition of a film-forming, chlorine-containing polymer and a destabilizing agent, said coating being deposited from a liquid composition directly on the metal surface to form an essentially integral film thereon.

2. Description of the Prior Art

The use of lubricant materials as surface treatment for metals in cold forming, including backward and forward extrusion procedures, is well known in the art. The simplest known methods involve the use of ordinary lubricating oils which have been utilized on various metal materials in die-forming and drawing procedures for a substantial period of time. Lubricating oils, however, have one drawback and that is they fail to provide satisfactory performance under extreme pressure conditions, especially as are encountered in the forming of harder metals such as steel with the result that the failure of the lubricant under these conditions results in scoring of the metal during the forming step. It is believed that this failure of the lubricants under these high-stress conditions is attributable to the squeezing out of the lubricant from between the work and the die under the high pressures used. Improved phosphate coating processes for these so-called impact extrusions, specifically relating to mild steels, were developed in the 1930's. These traditional processes, still widely used, employ a phosphate (zinc, iron, manganese) coating chemically applied to the surface of the workpiece or blank. The phosphate coating served a dual purpose, that of a separating layer and partial lubricant and as a lubricant absorbent and carrier. The lubricants employed and still in current application were soap such as sodium stearate soaps and other additives such as graphite or other extreme pressure lubricant additives. For other applications, compositions have been employed which contain pigment type additives which may be generally described as infusible. These pigments are intended to separate the die and the workpiece at the points of extreme deformation when the pressure or temperature during the drawing or forming process is too great to be withstood by conventional lubricating materials. Examples of such pigment additives are materials such as clay, lime, calcium carbonate, molybdenum disulfide, titanium dioxide and graphite. In this practice there is thus provided a dry lubricant composition which primarily consists of a high pressure lubricant material such as the insoluble or infusible pigment described above. For more severe application, this pigment technology has been added to the phosphate coating so that typical lubricant systems would consist of phosphate coatings, soap films and an infusible pigment such as molybdenum disulfide. These compositions and procedures are described in U.S. Pat. No. Re. 24,017.

The method described in the aforenoted Reissue Patent involves three basic co-acting factors which include formation of an integral coating directly on the work, application of an organic binder coating on the integral coating, said organic binder containing a dispersion of fusible pigments. The integral coating formed on the ferrous metal workpieces is brought about by electrochemical reaction of the iron with reactive materials to form chemical coatings such as iron sulfide, iron phosphate, iron oxalate, or iron fluoride. The organic binder material employed may include various synthetic and natural resins such as acrylics, alkyl resins, cellulose nitrate polymers, asphaltum, shellac, polyvinyl chloride, polyvinyl acetate, and styrene polymers and the like. The fusible pigments employed are those which have a Moh hardness of less than 5 and melt below the melting point of the work or the die, whichever is lower. The melting range is described as generally above 500°C. Examples of fusible pigments include aluminum stearate, antimony oxide, copper powder, lead borate, sulfur, etc.

In the process described in the U.S. Pat. No. Re. 24,017, the ferrous metal workpiece is provided with an integral, chemically bonded coating (i.e., ferrous sulfide) formed on the surface thereof which is then further coated with a composition of a fusible organic resin binder containing admixed therein an inorganic, fusible solid material as a secondary or high or extreme pressure lubricant. However, the phosphate methods are expensive and cumbersome to employ since the described procedures involve a chemical treatment of the metal surface which is difficult to control due to normal acid bath depletion, and the subsequent application of an organic coating represents a separate coating and handling operation.

More recently, organic polymers have been employed as the lubricant in the drawing of metals, particularly mild steel workpieces. Polymers which have been considered include polymethylmethacrylate polymer, polyethylene, polypropylene, polyvinyl chloride and nylon in solvent solutions. These procedures are described in *Sheet Metal Industries*, July, 1963. Solvents obviously present a toxicity and a flammability hazard.

In *Sheet Metal Industries*, October, 1967, Rao also describes the use of polyethylene as a lubricant in the deep drawing of workpieces. The application of the polyethylene to the workpiece was by a variety of procedures, including hot-dip, adhesives, cold spraying, flame spraying, extrusion coating, emulsion coats, and solution coating from solids.

Blake, et al. in *Meltallurgia and Metal Forming*, January, 1972, pp. 30 and 31, disclose the attempted use as lubricants of polyvinyl chloride films laid down from solvent systems. This procedure, however, did not give satisfactory results.

While these prior art procedures appear to have functioned satisfactorily in many respects, they do not produce the desired results under all conditions, especially the severe conditions encountered in backward and forward extrusion of metal and, more particularly, steel workpieces.

SUMMARY OF THE INVENTION

The present invention relates to a method of cold-forming a ferrous metal workpiece which comprises applying to a ferrous metal workpiece, free from other coatings or surface treatments, a coating of a lubricant drawing composition containing a film-forming, chlorine-containing polymer and a soluble or dispersible destabilizing agent. The coating is applied to the metal workpiece, dried, and the coated workpiece subjected to the forming process.

The present invention also relates to cold-forming lubricant compositions employed in said process, including liquid lubricant coating compositions suitable for direct application to a metal workpiece without the necessity of chemical preparation or special treatment applied thereto, said liquid coating compositions containing a liquid carrier, a film-forming, chlorine-containing polymer and a destabilizing agent. In one preferred form the liquid coating composition includes a water or aqueous vehicle as the carrier and the chlorine-containing polymeric material is in latex or dispersion form. The liquid carrier may also include liquid solvents which may be typified by organic solvents such as, for example, xylene, toluene or the like. While solvents may be employed in the broadest aspects of this invention, it should be understood that they present a problem with respect to flammability, toxicity of fumes to workers, recovery problems and an air pollution liability, difficulties which are not associated with the compositions which employ aqueous vehicles as the liquid carrier.

Broadly, the film-forming polymeric materials employed in the coating composition include chlorine-containing polymers or copolymers of monomers such as vinyl chloride, vinylidene chloride and epichlorohydrin. Other suitable polymeric materials which can be used include chlorinated polymers such as chlorinated polyethylene or other chlorinated polyolefins.

The film-forming copolymers of vinyl chloride or vinylidene chloride may include, in addition to the vinyl chloride and vinylidene chloride component, non-chlorinated comonomers such as acrylates and methacrylates which may be typified by acrylates such as ethyl, methyl and butyl, hexyl or octyl acrylates or other derivatives thereof, or by the use of other non-chlorine containing comonomeric constituents as are well known in the art such as ethylene, which form polymers which form films. Preferred polymers are copolymers which are film-forming at room temperature. The film-forming copolymers of vinyl chloride and alkyl acrylates are a preferred embodiment. Externally plasticized film-forming polymeric compositions are also contemplated for use herein, as well as internally plasticized copolymers such as the vinyl chloride. External plasticizers can include those conventionally used in this art such as dioctyl phthlate, dioctyl sebacate, dibutyl phthalate, succinic acid esters, and so-called polymeric plasticizers such as copolymers of succinic acid and glycols (e.g. ethylene glycol).

In addition to the copolymers recited above, particularly useful compositions are terpolymers such as those of vinyl chloride which contain a small amount, generally from between about 0.5 to 5% of an acidic comononmer such as, for example, acrylic acid or substituted acrylic acid, methacrylic acid, itaconic acid, and maleic acid, which improve the adhesion properties of the coating to the metal.

The polymeric material may be broadly described as having film-forming properties and, more particularly, film-forming properties from the latex form when the latex is dried at room temperatures. It should be also understood that the film-forming capacity relates to the ability of the polymeric materials to form a film when deposited from solvent solutions and includes polymer compositions that are externally plasticized.

The latices which are employed in the preferred form of forming lubricant composition may include broadly both those which are formulated as neutral latices or as basic or acidic latices.

In the formulation of the latices the polymer latex is customarily further diluted by the addition of water. Generally, the polymer is present in the latex to the extent of about 5 to 50% by weight thereof. Preferably, the polymeric material is present on a solids basis in an amount of from about 10 to 30% by weight of the aqueous latex. The chlorine in the latex composition may be present in amounts ranging from about 1.5 to 30%, preferably 3 to 18% chlorine.

The destabilizing agent employed in the present invention is a compound which is characterized as being preferably completely soluble or at least highly dispersible in water or whatever solvent may be employed in forming the liquid coating compositions of the present invention. Solubility or high dispersibility is desired in these compositions to assure that the destabilizing agent is adequately and uniformly throughout the composition and in the resulting film. It should be understood, however, that destabilizing agents which are soluble are preferred.

Broadly, the destabilizing agent is a compound or salt of a transition metal such as, for example, iron, cobalt, nickel, copper, zinc, chromium and manganese or salts of tin or aluminum. Salts may be in the form of halides, sulfates, nitrates, acetates, propionates, butyrates, citrates or the like. The most preferred salts are those which have anions formed from organic acids and nitrates. Other inorganic anions such as the chlorides and sulfates, while usable, appear to have some corrosion liability, which although minor in the present context, may limit their applicability in some applications. The destabilizing agent is generally present in amounts of from 0.25 to 10% based on polymer and preferably from 0.5 to 5%. Of the destabilizing agents formed from transition metals the most preferred are zinc acetate or zinc nitrate or mixtures thereof. In those situations where a basic or neutral latex is employed, it has been found that to prevent the precipitation of the destabilizing agent as the hydroxide or basic salt where such a reaction may occur, it is necessary to add a chelating agent. Chelating agents well known in the art are amino polycarboxylic acids such as EDTA and its salts, diethylene triamine pentaacetic acid and its salts (DTPA), gluconic and heptagluconic acids and their salts, citric acid, etc.

In addition to the destabilizing agents referred to above, non-metallic destabilizing agents such as free radical catalysts may be used. These include the preferred water soluble peroxides such as potassium persulfate and the water soluble hydroperoxides. Hydroperoxides such as cumene hydroperoxide, can be used and these are preferably employed in a redox system that includes ferrous sulfate. Less preferred catalysts include water dispersible catalysts such as benzoyl peroxide, lauroyl peroxide or the like and azo catalysts such as 2,2′-azo-bis-(isobutyronitrile) (AIBN).

The present invention contemplates application of the liquid coating composition on the workpiece to produce a dried coating weight thereon, which will range from about 0.1 to 2 grams per/sq.ft. and preferably from between about 0.5 to 1.5 grams per/sq.ft.

One of the objects of the present invention is to provide a lubricant system for the extrusion of ferrous metal workpieces which would eliminate the use of the phosphate treatment of the workpiece prior to drawing.

Other objects include the provision of coating compositions which may be easily applied directly to the work without the necessity of intervening coatings such as the phosphate treatment referred to above, but permit quick and easy removal of the coating from the workpiece after extrusion.

Moreover, it is a further object to provide a lubricant coating composition which will not produce residue build-up in the die which might intefere with continuous, repeated formings.

Further objectives are the provision of an extrusion lubricant coating composition which has minimal corrosive properties when applied to ferrous metal workpieces; has good stability in the liquid and particularly in the emulsion form; is relatively non-toxic and non-irritating (cutaneous); is simple to apply; and does not have objectionable odors.

While not wishing to be limited by any particular theory of operation, it is believed that the compositions of the present invention provide a system whereby an extreme pressure lubricant is generated in situ during the extrusion operations and under the temperature and pressure conditions encountered in the extrusion operation which prevents welding of the metal work to the die and consequent scoring of the work. While termed "destabilizing agent" it should be understood that the destabilization effect which occurs is limited to destabilization during the forming operation per se. The compositions in the solution or emulsion form, or as dry coatings applied to the workpieces, are essentially, completely stable materials.

DESCRIPTION OF THE PREFERRED EMBODIMENTS

The following examples will illustrate the compositions prepared in accordance with the present invention and will describe the formulations and procedures employed in coating and forming metal workpieces.

I. FORMULATIONS

The following describes four types of latex emulsion systems of the invention: (a) acidic latex with metal salt; (b) neutral or basic latex with metal salt; (c) neutral or basic latex with free radical initiator; and (d) neutral or basic latex with free radical initiator in redox system. The following also illustrates typical procedures used to make the formulations:

| | |
|---|---|
| A. Acidic Laytex with Metal Salt | |
| Zinc Nitrate | 1 pt.* |
| Add to Water | 75 pts. |
| then add 50 pts. copolymer of vinyl chloride-alkyl acrylate and acrylic acid [B.F. Goodrich Geon 460X2, 50% solids, pH 2.2] latex to above solution. | |
| B. Neutral or Basic Latex with Metal Salt | |
| Zinc Nitrate | 1 pt. |
| Dissolve in Water | 50 pts. |
| Add disodium salt of EDTA (Geigy Ciba Sequesterene $NA_2$) 2 pts. to solution | |

-continued

| | |
|---|---|
| Adjust pH, if necessary, to about 8 to 9 with ammonium hydroxide (or equivalent), then add 50 pts. copolymer of vinyl chloride-alkyl acrylate [B.F. Goodrich Geon 450X3] latex to above. | |
| C. Neutral or Basic Latex with Free Radical Initiator | |
| Cumene Hydroperoxide | 1 pt. |
| Add to water | 50 pts. |
| Adjust pH to above 8 to 9 then add Geon 450X3 latex 50 pts. to above. | |
| D. Neutral or Basic Latex with Free Radical Initiator in Redox System | |
| Ferrous Sulfate | 0.05 pt. |
| Dissolve in Water | 50 pts. |
| Add EDTA | 0.10 pt. |
| Add Cumene Hydroperoxide | 1 pt. |
| Adjust pH to about 8 to 9 with ammonium hydroxide or equivalent, then add Geon 450X3 latex, 50 pts. to above. | |

*pt. = part

II. COATING PROCEDURE

A. Emulsion Systems

The coating procedure used for small parts is barrel coating. Parts are rotated slowly in an open mesh barrel and dipped into the emulsion. After the steel is wetted by the emulsion, the barrel is lifted from the emulsion tank and drained over it. An air blast is directed over the parts to accelerate drying. Air temperatures used have been from ambient room temperature up to 100°F. with little influence of temperature on drying time which is about 5 to 10 minutes. By tumbling the parts during drying, sticking is prevented.

On large parts the procedure would be to dip the parts into the emulsion using an open mesh tray. Although the bottom of the part does not receive full coating, large parts are carried to the press and inserted with the coated face towards the punch.

It should be noted that the lubricant coating is adherent and not readily damaged. Small parts are dumped into hoppers and the lubricant must resist the impact experienced in transfer of the steel parts.

With emulsions, the preferred and practical bath temperature and part temperature during coating is room temperature, although higher temperatures can be used.

B. Solvent Systems

With solvent systems the bath temperature often has to be higher than ambient to maintain solubility of the polymer and to put down a uniform coating of the proper thickness on the steel.

III. EVALUATION OF LUBRICANTS

The lubricant formulations were evaluated by back extrusion of SAE 1018 steel slugs coated with the lubricant. Testing was done using a 60-ton capacity mechanical press with automatic ejection of the formed pieces. Slugs were fed into the press manually and the forming rate was about 10 to 12 pieces per minute. The criterion of acceptability used was the lack of score marks on the inner surface of the formed part when examined at 7× magnification. A lubricant must provide this scoring resistance at the severest conditions of test which are:

$$\text{A. Reduction of Area} = \frac{\text{Cross Sectional Punch Area}}{\text{Cross Sectional Die Area}} \times 100 = 70\%$$

$$\text{B. } \frac{\text{Inner Wall Height}}{\text{Punch Diameter}} = 3:1$$

-continued

C. Number of slugs tested 25

Criteria A and B represent about the severest conditions experienced in industrial extrusion of steel. Criterion C was established by experience as a lower limit needed to heat the tooling up to steady state conditions. If a lubricant remains promising after 25 slugs, it would usually prevent scoring on the one-hundredth slug, the practical limit on the number tested.

In testing a new lubricant, it was first evaluated at less severe conditions:

A. Reduction of area could be 50%

B. Height : Diameter = 2:1

C. Number of slugs = 5 to 10

Since the die diameter was fixed, A was varied by changing the punch diameter and B by changing the height of the steel slug to be formed. A lubricant passing these lower conditions would then be evaluated under more severe conditions until it would be either passed or rejected. Under the less severe conditions of test, tool steel punches could be used; however, under the severest conditions, the tool steel deformed under the heat generated and carbide punches had to be used. Besides providing scoring resistance, the lubricant must not build-up in the die cavity. Build-up results in difficulties in the insertion and injection of slugs.

IV. SPECIFIC EXAMPLES

EXAMPLE 1

An aqueous emulsion lubricant coating composition was prepared by diluting a B.F. Goodrich 460X2 latex about 50% solids as received with water to a 20% solids latex basis. The chlorine content of the polymer is approximately 30% which corresponds to about 53% vinyl chloride and the remainder being alkyl acrylate and acrylic acid (less than 5%) monomers. The latex as received has a pH of about 2.2.

To the diluted 20% solids latex was added 0.8% of zinc nitrate (polymer solids basis) which represents approximately 0.16% of zinc nitrate destabilizing agent in the final product. The pH of final emulsion was 2.

The aqueous emulsion was applied to a workpiece at a coating weight of about 0.7 gms. per/sq.ft. The mild steel (SAE 1018) slugs employed for coating purposes had a diameter of 0.687 inch, and a height of 0.669 inch. These slugs were backward extruded into a cup form to an inner wall height to a punch diameter ratio of about 3:1 by a die having a ring diameter of 0.698 inch. The plunger used in the forming operation had a diameter of 0.575 inch and the resulting reduction in cross-sectional area was about 70%. The head of the punch or plunger portion of the die is provided with a land which is approximately 0.005 inch greater than the diameter of the punch.

The coated slugs were drawn with good results and exhibited no scoring or marking of the product or die build-up.

The following Table will illustrate additional examples of latex or aqueous emulsion type lubricant coating compositions employing various polymers and destabilizing agents.

TABLE I

| EX. NO. | Polymer | Emulsion pH | Polymer Solids % | Destabilizing Agents | %[2] |
|---|---|---|---|---|---|
| 2 | Vinyl chloride-alkyl acrylate copolymer[1] (B.F. Goodrich Geon 450X3) | 9 | 20 | Cumene Hydroperoxide<br>$FeSO_4$<br>EDTA | 4<br>0.2<br>0.4 |
| 3 | Vinyl chloride-alkyl acrylate copolymer (Borden's POLYCO-2607) | 8 | 20 | Cumene Hydroperoxide<br>$FeSO_4$<br>EDTA | 4<br>0.2<br>0.4 |
| 4 | Vinyl chloride-alkyl acrylate copolymer (National Starch Co. VYNACLOR 2523) | 8 | 25 | Cumene Hydroperoxide<br>$FeSO_4$<br>EDTA | 4<br>0.2<br>0.4 |
| 5 | Vinyl chloride-alkyl acrylate copolymer (Geon 460X2) | 3 | 20 | Zinc Acetate | 0.4 |
| 6 | Vinyl chloride-alkyl acrylate copolymer (Geon 460X2) | 1 | 20 | $ZnCl_2$ | 4 |
| 7 | Vinylidene chloride copolymer, 60% chlorine (Geon 660x1) | 1 | 20 | $ZnCl_2$ | 4 |
| 8 | Vinyl chloride-alkyl acrylate copolymer (Geon 450X3) | 8 | 25 | Zinc Nitrate<br>EDTA | 4<br>8 |
| 9 | Vinyl chloride-alkyl acrylate copolymer (Geon 450X3) | 8 | 25 | Potassium Persulfate | 4 |
| 10 | Vinyl chloride-alkyl acrylate copolymer (Geon 460X2) (1 part) plus Acrylic polymer Hycar 2671 (1 part) | 5 | 31 | Zinc Acetate[3] | 5.4 |
| 11 | Vinyl chloride-alkyl acrylate copolymer (Bordens Polyco 2607) | 9 | 20 | Zinc Nitrate<br>Tetrasodium EDTA | 2<br>8 |
| 12 | Vinyl chloride-alkyl acrylate copolymer (Geon 460X2) | 3 | 20 | Cobaltous Acetate | 1 |
| 13 | Vinyl chloride-alkyl acrylate copolymer (Polyco 2607) | 9 | 20 | Cobaltous Acetate<br>Tetrasodium EDTA | 2<br>8 |
| 14 | Vinyl chloride-alkyl acrylate copolymer (Geon 460X2) | 2 | 20 | Stannous Chloride<br>Disodium EDTA | 2<br>4 |
| 15 | Vinyl chloride-alkyl acrylate copolymer (Geon 460X2) | 2 | 20 | Aluminum Nitrate<br>Disodium EDTA | 1<br>2 |
| 16 | Ethylene-vinyl chloride copolymer (Monsanto Monflex 4500) | 5 | 25 | Zinc Nitrate<br>Disodium EDTA | 1<br>2 |
| 17 | Plasticized vinyl chloride-alkyl acrylate copolymer with 35 phr dioxtyl phthalate (Geon 576) | 10 | 20 | Zinc Nitrate<br>Tetrasodium EDTA | 2<br>8 |
| 18 | Mixture of two vinyl chloride-alkyl acrylate copolymers (Polyco 2607, 0.85 part; Polyco 2612, 0.15 part) | 10 | 20 | Zinc Nitrate<br>Tetrasodium EDTA | 2<br>8 |
| 19 | Chlorinated polyethylene (48% chlorine) in xylene | | 5 | Nickel Acetyl Acetonate | 4 |

TABLE I-continued

| EX. NO. | Polymer | Emulsion pH | Polymer Solids % | Destabilizing Agents | %[2] |
|---|---|---|---|---|---|
| 20 | Epichlorohydrin polymer (B.F. Goodrich Co. Hydrin 200) in MEK | | 5 | Nickel Acetyl Acetonate | 3 |
| 21 | Polyvinyl chloride resin (GEON 103) in cyclohexanone | | 5 | Molybdenum Naphthenate | 3 |

[1]50/50 vinyl chloride, alkyl acrylate copolymer
[2]Based on polymer solids
[3]Based on vinyl chloride copolymer solid On testing, all formulations gave no scoring or die build-up where tested in accordance with procedures.

V. INDUSTRIAL EVALUATION

In addition to the pilot plant tests, the lubricant has been evaluated in a production test in a commercial plant. Parts coated with the lubricant were evaluated on a 500-ton capacity mechanical press. The parts were slugs of SAE 1016B steel which were sent through the first step of manufacture, a heading operation. The pieces were then coated with lubricant and dried. The slugs were back extruded under production conditions. This forming operation is part of the sequence used to manufacture track link bushings.

The following summarizes the information on this production evaluation:

| | |
|---|---|
| Lubricant | |
| Geon 460X2 | 100 parts |
| Water | 100 parts |
| Zinc Nitrate (with respect to polymer solids 0.67%) | 0.33 parts |
| Coating Procedure | |
| Barrel coating followed by warm air drying. | |
| Slugs | |
| Total Number | 25 |
| Diameter | 2-9/32 inch |
| Height | 2-7/8 inch |
| Extrusion Conditions | |
| Back extrusion using carbide punch | |
| A. Reduction in area = 42% | |
| B. $\frac{\text{Inner wall height}}{\text{Punch Diameter}} = 2.8:1$ | |

The first step of evaluation involved insertion of a series of 10 slugs manually into the press and forming. It was found that no scoring of the inner surface of the formed parts had occurred. The next step was to insert 15 slugs into the press conveyor which feeds the press. The press was then started and the slugs fed at the normal production rate of 22 parts per minute.

On inspection of the slugs coated with the latex lubricant, no scoring was found.

As noted above, it has also been determined that the lubricant composition can be applied to to a workpiece or blank from a solvent solution rather than as an emulsion or latex. In such a composition, 5 parts of a polymer such as Geon 103 (polyvinyl chloride) is dissolved in 95 parts of cyclohexanone to which is added 0.1 part of benzoyl peroxide to form a 5% solution. The destabilizing agent employed should be soluble in the solvent used in forming the solution. For this purpose, metal compounds of the class described should be metal-organic compounds with sufficiently large organic groups to permit solubilization in the organic solvent. Organic solvents other than xylene, such as toluene, chlorinated solvents, etc. may also be used. It should be understood that while solvent systems may be employed, they are not preferred in view of flammability hazard, cost, pollution factors and the like.

It should be understood that for best performance, the compositions should include the destabilizing agent in a soluble form to assure distribution throughout the system. The free radical catalysts employed should also be either soluble or dispersible in the system, again to assure uniform distribution.

The coating compositions of this invention are capable of application to the workpiece, stable in the emulsion form as well as a dried coating on the workpiece item, form a uniform film or coating on the workpiece when applied from the liquid coating bath, are essentially non-corrosive and readily removed from the piece after forming. They provide lubrication and good results on ferrous metal cold extrusions (backwards and forwards) without scoring or die build-up at high deformation, i.e., in back extrusion with height to diameter ratios of say 3:1. Further, no intervening phosphate or other metal surface treatment is required, but application of the lubricant may be directly to the surface of the clean metal workpiece.

What is claimed is:

1. A method of cold extrusion of a ferrous metal workpiece which comprises:

a. applying a liquid lubricant composition directly to the untreated surface of a ferrous metal workpiece, said composition comprising:
   1. an inert liquid carrier vehicle selected from the group consisting of water and organic solvents;
   2. a chlorine-containing polymer which is film-forming at room temperature, selected from the group consisting of polymers and copolymers of vinyl chloride, vinylidene chloride, and epichlorohydrin and chlorinated polyolefin polymers which are relatively non-corrosive to steel, said liquid composition having a chlorine content in bound polymeric form of from 1.5 to 30% by weight (wet basis); and,
   3. a destabilizing agent selected from the group consisting of salts of the transition metals, tin, aluminum and water soluble free radical catalysts selected from the group consisting of peroxides and hydroperoxides, said destabilizing agent being present in an amount of from 0.25 to 10% based on polymer solids.

b. drying the coated workpiece to remove the vehicle and form a dry, essentially continuous, uniform film of the polymeric material and the destabilizing agent on the surface thereof; and c. subjecting the coated workpiece to a cold extrusion process, said chlorine-containing polymer and destabilizing agent providing an extreme pressure lubricant under the temperature and pressure conditions of the extrusion process.

2. A process according to claim 1 wherein the coating is applied at a rate of 0.1 to 2 g/ft$^2$.

3. A process according to claim 1 wherein said liquid coating is in emulsion form and said carrier vehicle is water.

4. A process according to claim 1 wherein the chlorine-containing polymer is a copolymer of vinyl chloride and a comonomer selected from the group consisting of alkyl acrylates and alkylmethacrylates and ethylene.

5. A process according to claim 1 wherein the chlorine-containing polymer is a copolymer of vinylidene chloride and a comonomer selected from the group consisting of alkyl acrylates and methacrylates and ethylene.

6. A process according to claim 1 wherein the chlorine-containing polymer is a copolymer of vinyl chloride and alkyl acrylate and the destabilizing agent is zinc acetate.

7. A process according to claim 1 wherein the chlorine-containing polymer is a copolymer of vinyl chloride and alkyl acrylate and the destabilizing agent is a zinc nitrate.

* * * * *

UNITED STATES PATENT AND TRADEMARK OFFICE

CERTIFICATE OF CORRECTION

PATENT NO. : 3,978,702

DATED : September 7, 1976

INVENTOR(S) : George E. Barker, Stephen C. Cohen, John L. O'Brien and Jack Milgrom It is certified that error appears in the above-identified patent and that said Letters Patent are hereby corrected as shown below:

In the References Cited, Patent No. 3,250,013 should be -- 3,250,103 --

| | | |
|---|---|---|
| Col. 5, l. 51 | - | "Laytex" should be -- Latex -- |
| Col. 10, l. 57 CLAIM 1 | - | The period (.) should be a semicolon -- ; -- |
| Col. 12, l. 10 CLAIM 7 | - | Delete "a" after "is" |

Signed and Sealed this

Ninth Day of November 1976

[SEAL]

*Attest:*

RUTH C. MASON
*Attesting Officer*

C. MARSHALL DANN
*Commissioner of Patents and Trademarks*